United States Patent [19]

Aronoff et al.

[11] 4,150,948

[45] Apr. 24, 1979

[54] METHOD FOR TREATING TUBULAR FABRICS

[75] Inventors: Edward I. Aronoff, St. Laurent; William J. McLay, Montreal, both of Canada

[73] Assignee: Knit-Fin Machinery Ltd., Montreal, Canada

[21] Appl. No.: 856,137

[22] Filed: Nov. 30, 1977

Related U.S. Application Data

[62] Division of Ser. No. 754,951, Dec. 28, 1976, Pat. No. 4,068,501.

[30] Foreign Application Priority Data

Oct. 25, 1976 [CA] Canada ..... 264255

[51] Int. Cl.[2] ..... D06B 1/08

[52] U.S. Cl. ..... 8/151; 8/158

[58] Field of Search ..... 8/151, 158; 68/DIG. 5, 68/205 R, 62

[56] References Cited

U.S. PATENT DOCUMENTS

| | | | |
|---|---|---|---|
| 3,922,738 | 12/1975 | Holm | 8/151 |
| 4,016,733 | 4/1977 | Fleissner | 68/DIG. 5 |

FOREIGN PATENT DOCUMENTS

| | | | |
|---|---|---|---|
| 499045 | 5/1930 | Fed. Rep. of Germany | 68/205 R |
| 529588 | 9/1921 | France | 68/205 R |

*Primary Examiner*—Philip R. Coe

*Attorney, Agent, or Firm*—Swabey, Mitchell, Houle, Marcoux & Sher

[57] ABSTRACT

A continuous washing machine has an impregnation bath and a rinsing chamber. The rinsing chamber includes three successive sieve drums over which the tubular fabric is made to pass. The fabric passes over the second downstream sieve drum in a reverse direction so as to overturn the fabric and expose the other surface thereof and to retain the fabric over the sieve drum. A sump area is maintained in the bottom of the chamber, and the liquors from the sump are recirculated by means of spray pipes spraying rinse liquor onto the fabric. The spent rinse liquor coming from the fabric over the first sieve drum is drained out of the chamber.

2 Claims, 1 Drawing Figure

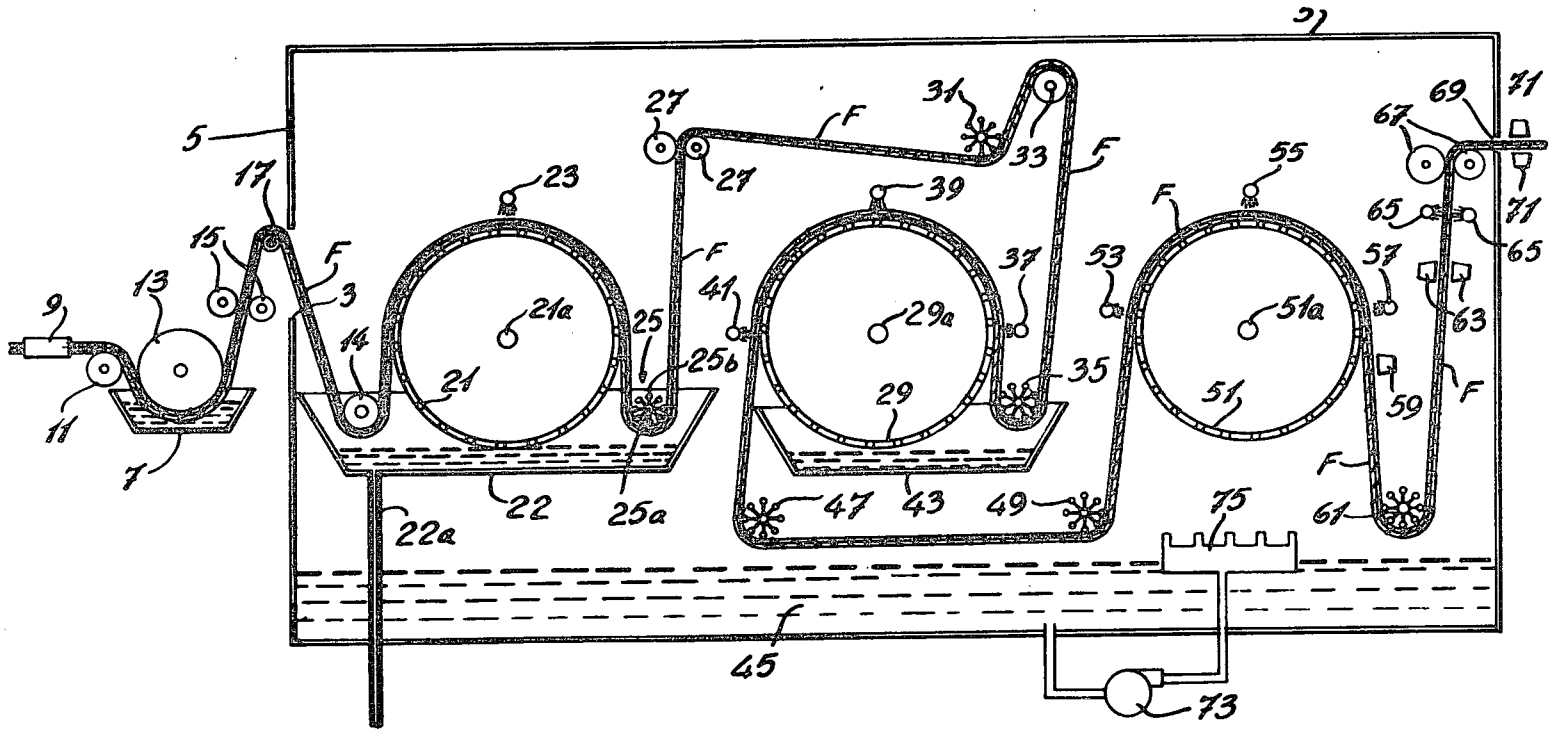
1
3
5
7
9
11
13
14
15
17
21
21a
22
22a
23
25
25a
25b
27
29
29a
31
33
35
37
39
41
43
45
47
49
51
51a
53
55
57
59
61
63
65
67
69
71
73
75
F

METHOD FOR TREATING TUBULAR FABRICS

This is a divisional of application Ser. No. 754,951, filed Dec. 28, 1976, and now U.S. Pat. No. 4,068,501.

BACKGROUND OF THE INVENTION

1. Field of the Invention the present invention relates to and a method for treating tubular fabrics, and in particular, to a method for continuously wet treating a fabric, especially a knitted tubular fabric.

2. Description of the Prior Art

It has been known to merely wash a tubular fabric, as shown in U.S. Pat. No. 3,563,065, issued Feb. 16, 1971, H. Fleissner, inventor. The important thing in a wet treatment or washing of tubular fabrics is to properly expose both flat surfaces of the tubular fabric to the liquor treatment. Accordingly, in Fleissner, a pair of drums which are perforated are provided one above each other such that the fabric, as it worms its way around the two rollers, will expose successively both surfaces of the fabric. However, it is believed that such a system, although it may be very effective for washing the fabric, may not be proper to rinse the fabric.

SUMMARY OF THE INVENTION

Accordingly, it is an aim of the present invention to provide an efficient, high speed method for washing and rinsing a tubular knitted fabric. It is a further aim of the present invention to provide a method for washing a tubular fabric which consumes a minimum amount of water.

In a method in accordance with the present invention, a tubular fabric is first passed through a liquid treatment bath and into a rinsing chamber; the fabric is passed through a first rinsing station where it is supported along a support surface and is sprayed, reversing the fabric such that the other surface of the tubular fabric is exposed as it passes through a second rinsing station, at which time the fabric is again supported on a support surface and is being sprayed, extracting spent liquors within the fabric and withdrawing the fabric from the rinsing chamber.

BRIEF DESCRIPTION OF THE DRAWINGS

Having thus generally described the nature of the invention, reference will now be made to the accompanying drawing, showing by way of illustration, a preferred embodiment thereof, and in which:

The drawing is a schematic side elevation of a typical washing apparatus in accordance with the present invention.

DESCRIPTION OF THE PREFERRED EMBODIMENTS

Referring now to the drawing, there is shown schematically a closed-in tank 5 having an inlet 3 and a sump area 45.

Immediately upstream of the inlet 3 is an impregnation station including a quetch or at least a driven stretcher frame 4 delivering the tubular fabric F into an impregnation bath 7 by means of the guide roller 11 and around the sieve drum 13. The sieve drum 13 would be constructed with a screen-like mesh to allow the liquid in the bath to penetrate the fabric from both sides thereof. The sieve drum 13 could be driven. The type of liquor used in the present embodiment would be a washing detergent, and the fabric, once it leaves the bath 7, passes between squeeze rollers 15 which remove the excess detergent liquid from the fabric F and allows it to drip back into the impregnation bath 7.

The fabric then passes over an idler guide roller 17 and through the inlet opening 3 of the tank 5, and then under an idler guide roller 19 and over a large sieve drum 21. A drainage tray 22 is provided underneath the sieve drum 21 and is connected to a drain pipe **22*a* to drain the spent liquid dripping into the tray 22, from the system. A rinsing spray pipe 23 extends parallel to the axis of the sieve drum 21 and sprays the liquid onto the fabric F as it passes over the sieve drum 21**.

The fabric F then passes underneath an idler beater roller 25 and then vertically up through the squeeze rollers 27. The beater roller includes a shaft **25*a* and a plurality of tubes or rods 25*b* equally distributed concentrically with the shaft 25*a*. As the fabric passes around the so-called beater roller 25, the polygonal surface effect of the rods causes the fabric to agitate slightly, thereby helping to reduce the build-up of air within the tubular fabric which would form an undesirable bubble which might cause distortion in the fabric. The passing of the fabric upwardly in a vertical plane through the squeeze rollers 27 also has the effect of forcing the water to cascade down the plane of the tubular fabric into the drainage tray 22. The fabric F then passes overhead in the tank 5 under a further beater roller 31 and over a guide roller 33. Below the fabric F is a sieve drum 29 mounted on a driven shaft 29*a*. The fabric is passed through the circuitous path of travel about the rollers 27, 31 and 33 as well as the beater roller 35, in order to lay the fabric F on the sieve drum 29**, exposing the other surface of the fabric. It has been found preferable to pass the fabric over the sieve drum as opposed to the simpler method of passing it under the sieve drum to expose the other face of the fabric. The fabric in this manner is being supported by the sieve drum as spray rinse water is impregnated in the fabric rather than underneath the drum where the added weight of the liquid would tend to pull the fabric away from the drum, causing some tension and certain distortion in the fabric.

As the fabric passes the beater roller 35 onto the sieve drum 29, a first rinse spray pipe 37 is provided as well as spaced-apart spray pipes 39 and 41. A collector tray 43 is provided under the sieve drum 29, but drains immediately into the sump area 45. The fabric, as it comes off the sieve drum 29, passes underneath a beater roller 47 and a further beater roller 49, which guides the fabric in a horizontal path directly underneath the sieve drum 29. The tray 43 is provided to prevent the water draining off the fabric F as it passes over the sieve drum 29 from cascading onto the fabric F as it passes on the horizontal plane between the beater rollers 47 and 49.

The fabric F is then passed over a third sieve drum 51 past the spray pipes 53, 55 and 57, which are provided for supplying further rinse water onto the advancing fabric F. The sieve drum 51 is similarly mounted on a drive shaft **51*a*. As the fabric F passes over the sieve drum 51 and under the spray pipes 53, 55 and 57, it advances downstream past a first vacuum box 59 which has a slit extending across the width of the fabric to help extract some of the air building up in the fabric and to further reduce the possibility of a bubble forming, especially prior to the squeeze rolls 67. As the fabric F advances in a vertical plane from the beater roll 61 to the squeeze rolls 67, it passes between two further vacuum boxes 63 and then to a pair of parallel spray pipes 65 which will spray the fabric along its width thereof from both sides with fresh water or other rinsing liquor. The liquid will cascade down the surface of the fabric in the vertical plane and will drip into the sump area 45 of the tank 5. Finally, the fabric F passes through the pair of squeeze rolls 67 to remove most of the excess rinse liquid in the fabric, and the fabric passes out of the tank 5 through the outlet 69 between the further vacuum boxes 71** which reduces the humidity within the fabric.

All of the water being sprayed onto the fabric over the sieve drums 29 and 51 as well as with the spray pipes 65, falls into the sump area 45. The water being sprayed by means of spray pipe 23 onto the fabric in the area of the drum 21 is collected in the drain tray 22 and is taken away from the system by means of the drain pipe 22*a*. The rinsing water in the sump area 45 is recirculated to the spray pipes 37, 39, 41, 53, 55 and 57 as well as the spray pipe 23 by means of a pump 73 through a manifold 75. Communicating conduits (not shown) extend from the manifold 75 to the various drain pipes mentioned. The amount of water being fed to the spray pipe 65 from outside the system equals approximately the amount of spent rinse water being drained from the drain tray 22.

We claim:

1. A method for the liquid treatment of a tubular fabric, including the steps of: (A) passing the fabric in a flat condition defining opposite sides through a liquid-treating impregnation station bath and advancing the fabric through a rinsing station which includes passing the fabric over the top of a first rotating drum with one side of the fabric on the drum; (B) spraying fluid from above onto the fabric as it passes over the first rotating drum, so that fluid drains through the fabric and drum; (C) advancing the fabric and reversing the direction of the fabric so that it engages above a second rotating drum with the opposite side of the fabric exposed; (D) spraying rinsing fluid from above, onto the reversed fabric as it passes above the second rotating drum so that fluid drains through the fabric and drum; (E) agitating the fabric between the drums as it moves in its path between the drums to reduce the build-up of air within the flattened fabric; and (F) removing excess liquid from the fabric as it exits from the rinsing station.

2. A method as defined in claim 1, wherein the fabric, after it has passed over the second rotating drum, is moved to a third rotating drum and is passed above this third rotating drum and further rinse fluid is sprayed onto the fabric, drains through the fabric and then the excess liquids are removed from the fabric as it exists from the third rotating drum, collecting the rinsing fluid from the second and third rotating drums and recirculating the rinsing fluid through the fabric while spent liquors coming from the first rotating drum, and supplying into the rinsing station fresh fluid in an amount equal to the spent liquors being removed from the area of the first rotating drum.

* * * * *